US008925757B2

(12) United States Patent
Baratte

(10) Patent No.: US 8,925,757 B2
(45) Date of Patent: Jan. 6, 2015

(54) TASTING GLASS

(75) Inventor: Arnaud Baratte, Palleville (FR)

(73) Assignee: Arnaud Baratte Corporate International, Palleville (FR)

( * ) Notice: Subject to any disclaimer, the term of this patent is extended or adjusted under 35 U.S.C. 154(b) by 528 days.

(21) Appl. No.: 13/143,642

(22) PCT Filed: Jan. 11, 2010

(86) PCT No.: PCT/EP2010/050206
§ 371 (c)(1), (2), (4) Date: Aug. 30, 2011

(87) PCT Pub. No.: WO2010/079225
PCT Pub. Date: Jul. 15, 2010

(65) Prior Publication Data

US 2011/0303680 A1 Dec. 15, 2011

(30) Foreign Application Priority Data

Jan. 12, 2009 (FR) ..... 09 50126

(51) Int. Cl.

| | |
|---|---|
| ***B01F 11/00*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 6/28*** | (2006.01) |
| ***B65D 8/06*** | (2006.01) |
| ***A47G 19/22*** | (2006.01) |

(52) U.S. Cl.
CPC ..... *A47G 19/2205* (2013.01); *A47G 19/2233* (2013.01); *A47G 2400/045* (2013.01)
USPC ..... 220/608; 220/568; 220/669; 220/670; 215/382

(58) Field of Classification Search
USPC ..... 220/608, 568, 669, 670; 215/382, 215/DIG. 1, DIG. 8
See application file for complete search history.

(56) References Cited

U.S. PATENT DOCUMENTS 2,627,184 A * 2/1953 Jones ..... 73/427
3,341,184 A * 9/1967 Merrill ..... 366/349
(Continued)

FOREIGN PATENT DOCUMENTS

AU 2005 239 717 A1 6/2006
EP 1 994 862 A1 11/2008
(Continued)

OTHER PUBLICATIONS

International Search Report, dated Aug. 12, 2010, from corresponding PCT application.

*Primary Examiner* — Fenn Mathew
*Assistant Examiner* — Andrew T Kirsch
(74) *Attorney, Agent, or Firm* — Young & Thompson

(57) ABSTRACT

The tasting glass (1), of the type including a parison (2) generally being rotationally symmetrical around a vertical axis, includes within the parison (2) a set of at least two internal ribs (7) evenly distributed on the periphery of the parison (2), extending in a substantially vertical plane, almost from the bottom of the glass, up to a height of the parison (2) lower than the normal filling level of the glass, different for each of the ribs (7). The tasting glass also includes a dome (8), called "nose-cap", located on the axis of the glass at the bottom of the parison (2). The ribs (7) each have the shape of a propeller blade surface. A method for producing the glass is also described.

15 Claims, 5 Drawing Sheets

(56) References Cited

U.S. PATENT DOCUMENTS

Figure 1:
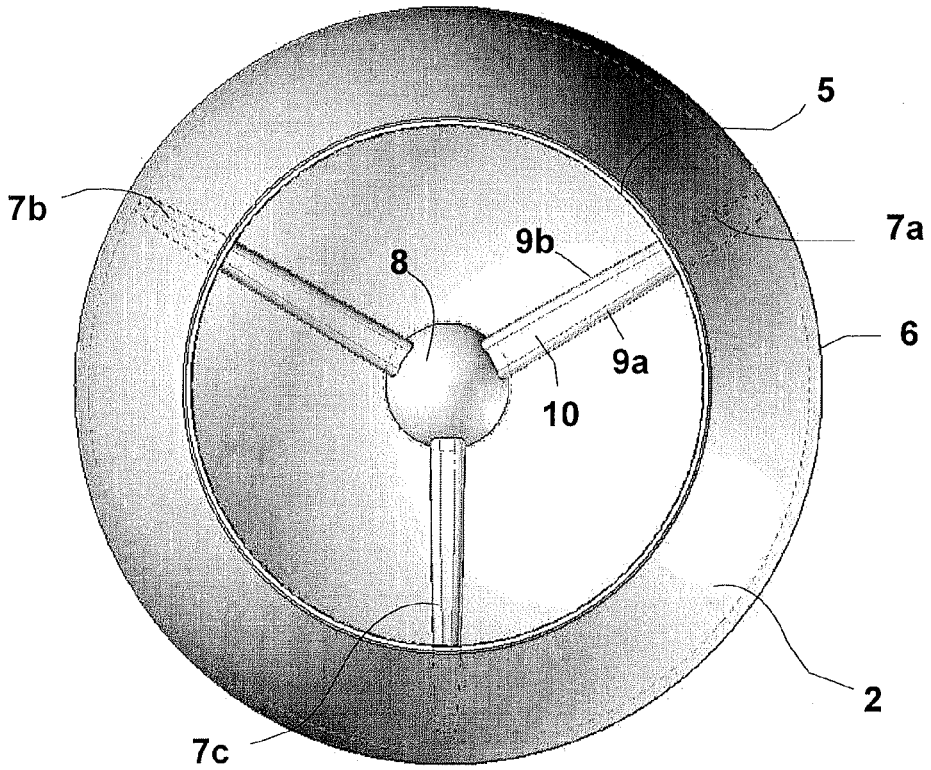

| | | | | |
|---|---|---|---|---|
| 4,665,035 | A * | 5/1987 | Tunac | 435/304.2 |
| 4,880,312 | A * | 11/1989 | Carlson | 366/130 |
| 7,381,559 | B2 * | 6/2008 | Ellis et al. | 435/288.1 |
| 2007/0267422 | A1 * | 11/2007 | Barducci | 220/608 |

FOREIGN PATENT DOCUMENTS

| | | |
|---|---|---|
| FR | 2 684 534 A1 | 6/1993 |
| FR | 2 788 210 A1 | 7/2000 |
| FR | 2 817 134 A1 | 5/2002 |
| GB | 1 421 680 A | 1/1976 |

* cited by examiner

TASTING GLASS

BACKGROUND OF THE INVENTION

The present invention belongs to the field of oenology. It relates more specifically to glasses designed for wine tasting.

DESCRIPTION OF THE RELATED ART

It is known in oenology that a single wine does not have the same smell and the same taste, with respect to the same taster, when poured and drunk in glasses of different shapes.

This effect is due to several physical and chemical phenomena. Wine is composed of multiple elements, including ethanol, acetaldehyde and glycerol molecules, tannins, phenolic and volatile compounds, esters, mineral and vegetable matter, volatile acids, etc. These different molecules are released into the air surrounding the wine more or less quickly depending on the geometry of the glass. For example, the ratio of the free surface of the wine, which partly determines the rate of release of flavors from and oxygenation of the wine, to the volume of wine in the glass thus partly explains the choice of balloon-, tulip- or flute-shaped, etc. glasses. A young red wine needs oxygenation, which justifies a greater free wine surface, whereas, on the contrary, an older wine requires this oxygenation less, and is preferably drunk in smaller diameter glasses.

The desire to keep the flavors in a slightly-ventilated volume of air justifies the choice of a diameter in the upper part of the glass, called "rim", which is smaller than the container part of the glass, called "parison".

Similarly, it is known that the taste buds located in different areas of the mouth of the taster are not dedicated to the perception of the same flavors: certain parts are particularly dedicated to the detection of bitterness, others to the perception of acidity, yet others to the perception of the sweet or salty nature of food, etc. The shape of the upper part of the glass thus directs the wine, when drunk, towards certain taste buds as a priority, creating something of a taste playback sequence of the wine that highlights one or another of its qualities.

The choice of a suitable glass for a premium wine, which required great effort to create, can thus be decisive in the taster's perception of its quality.

The internal shape of the glass therefore becomes the subject of studies and creation.

Glasses specifically designed to favor a particular type of wine have already been proposed in the prior state of the art.

Various means to bring out the flavors more quickly have been envisaged, most often by creating turbulence in the wine when the glass is subjected to a very traditional circular motion.

Of these, patent FR 2 684 534 from 1991 shows a glass comprising a stop edge protruding into the inner part of the parison, substantially at the free surface of the wine, to disrupt the rotational movement of the wine and create turbulence in the wine when the glass is moved in rotation and thus facilitate the release of the aromatic molecules.

Similarly, patent FR 2 817 134 from 2000 describes a glass comprising, on the inside of its parison, a rib extending along a generatrix of the parison surface, from the bottom of the glass to the rim. This rib is preferably in the shape of a facet locally perpendicular to the parison of the glass. It possibly consists of a local break away from the parison's peripheral contour. It also causes strong local turbulence in the wine, in order to bring out its aromatic molecules.

The drawbacks of these different implementations are either limited effectiveness or, on the contrary, real turbulence (exposed sharp edges of the ribs, break in the path of the wine), which is more likely to cause such effects as mixing of the wine and phenol breakdown amongst others, rather than light oxygenation and expression of the flavors.

SUMMARY OF THE INVENTION

The goal of this invention is to achieve an expression of the flavors of the wine by creating stirring movements within the glass.

In a second goal, the invention seeks to avoid breaking certain molecules present in the wine by overly forceful stirring, and rather to shake them in uniform manner.

To this end, the invention relates to a drinking glass, of the type comprising a parison with rotational symmetry around a vertical axis, comprising within said parison a set of at least two internal ribs evenly distributed on the periphery of the parison, each extending substantially along a generatrix of the parison, almost from the bottom of the glass, up to a height of the parison lower than the normal filling level of the glass, different for each of the internal ribs.

The internal ribs are angularly distributed in an even way to bring about a uniform stirring of the wine; this is not achieved with a single rib, which tends to disrupt the aromatic development of the wine, or with ribs protruding at too great an angle to the parison.

It can also be seen that it is desired here that the stirring effect stops beneath the level of the free surface of the wine to avoid surface turbulence effects.

According to an advantageous embodiment, the height of each internal rib corresponds to a normal fill level of the glass.

Here, the effect of stirring the contained wine is combined with easier visual measurement of the volume of wine poured into the glass.

Preferably, the glass comprises three internal ribs as described.

These three internal ribs then advantageously have heights corresponding respectively to seven, eleven and fifteen centiliter fillings of the glass, which correspond to the most traditional filling levels of a single glass.

According to a preferred embodiment, the internal ribs protrude from the inner surface of the parison.

This arrangement corresponds to a simpler realization of the glass and allows more complex rib sections to be realized.

Advantageously, the glass also includes, at the bottom of the parison, substantially along the vertical axis of symmetry of the glass, a protruding dome, called "nose-cap", into which the internal ribs fuse.

It can be seen here that the objective is to push, to press the wine up against the inner wall of the glass, thus producing increased friction between the materials making up the glass and the wine. This principle facilitates all the more the release of the various flavors.

Alternatively, in the case of champagne glasses, the glass also comprises at the bottom of the parison a hollow dome on which the internal ribs fuse.

In this case, the hollow dome advantageously comprises between forty and eighty impacts, called "bubble hooks", which allow the bubbles to rise uniformly at the center of the glass, in the shape of a chimney; this allows the formation of a real crown of foam at the periphery of the liquid.

In order to allow satisfactory development of the wine's flavors, the internal ribs preferably have a section similar to that of a propeller blade surface and of the nose-cap.

The invention also relates to a method for producing a glass as described, comprising steps in which:

- the parison is created in a turned and blown mold and the dome is realized by deformation of the bottom of the parison by the upper extremity of the stem,
- the stem is created in a fixed press mold or as a stretched stem, and the foot is created in a fixed press mold,
- the stem and foot are assembled onto the parison,
- a jaw system suitable for industrial production is manufactured to mount the foot on the bottom of the stem,
- a seam going from the stem to the foot is glazed if the leg is realized in a fixed press mold.

BRIEF DESCRIPTION OF THE DRAWING FIGURES

Figure 2:
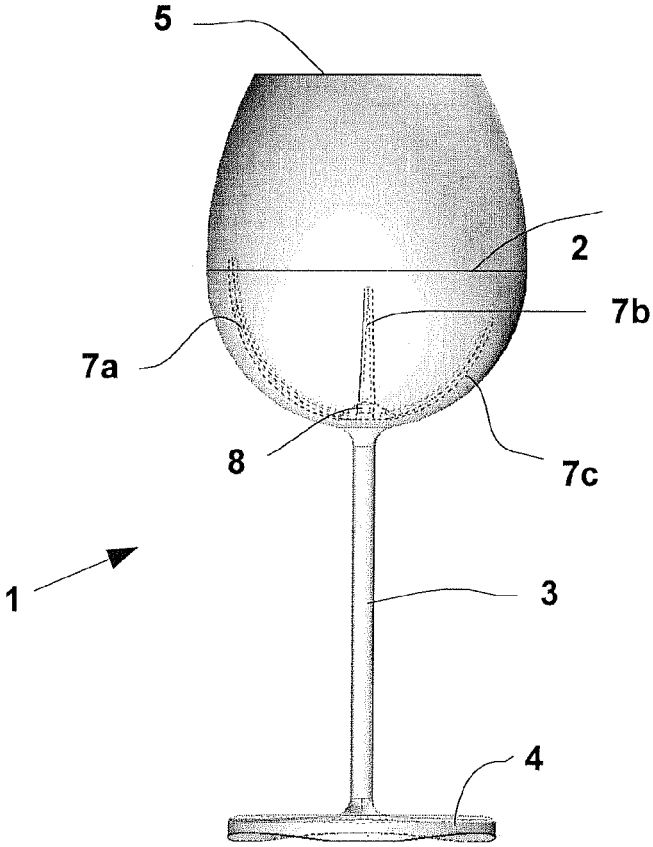
Figure 3:
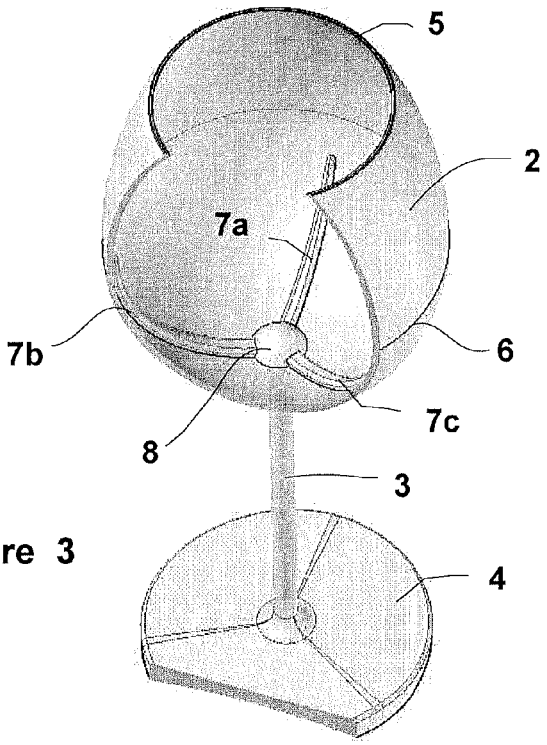
Figure 5:
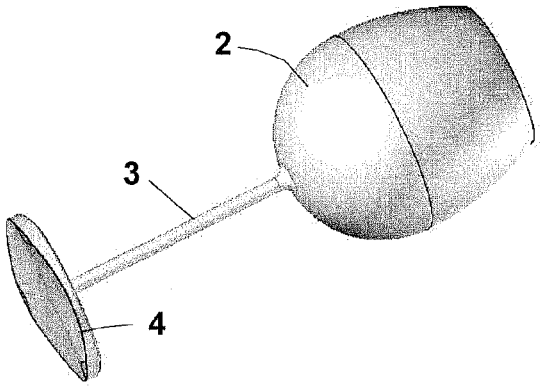
Figure 4:
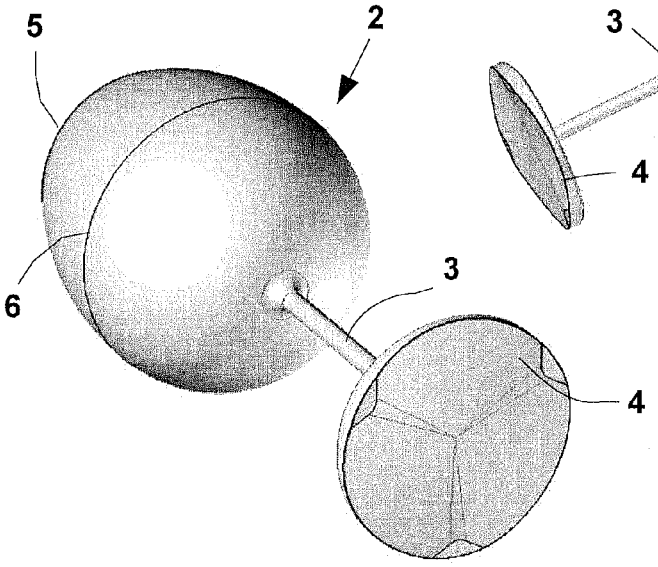
Figure 6A:
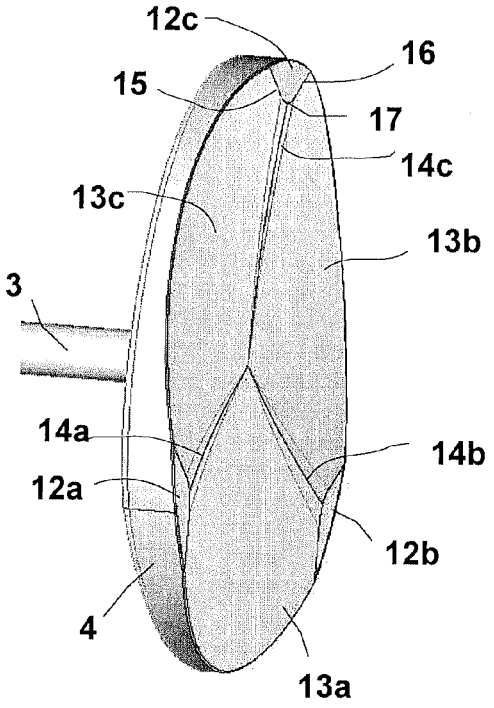
Figure 6B:
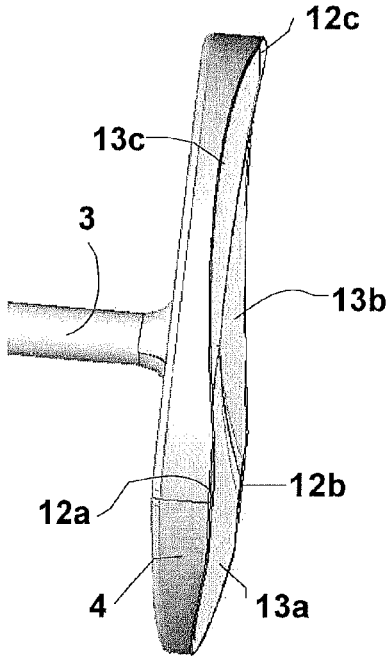
Figure 6C:
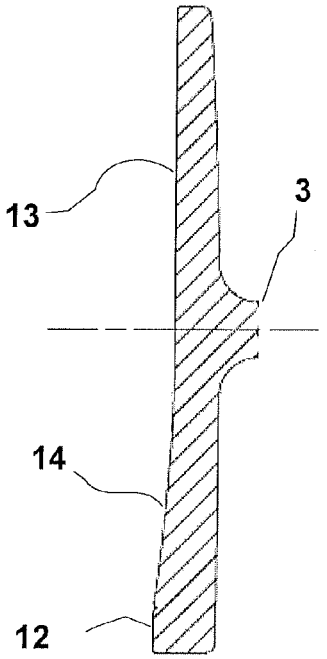
Figure 7:
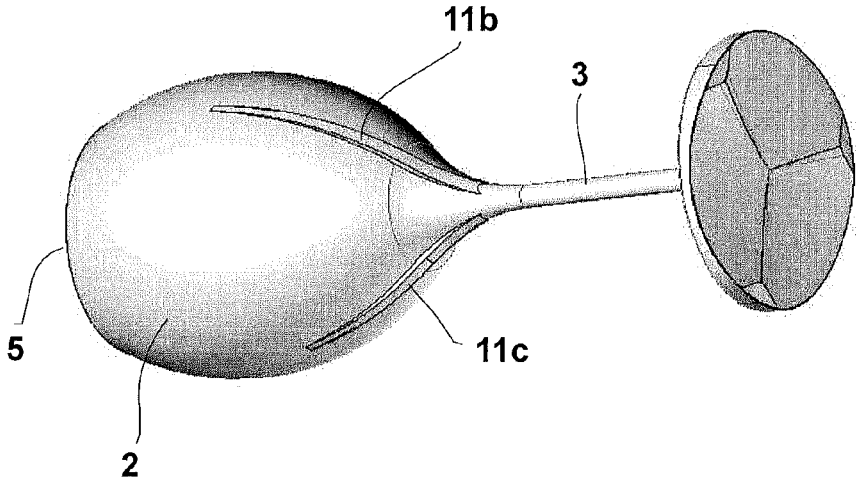
Figure 8:
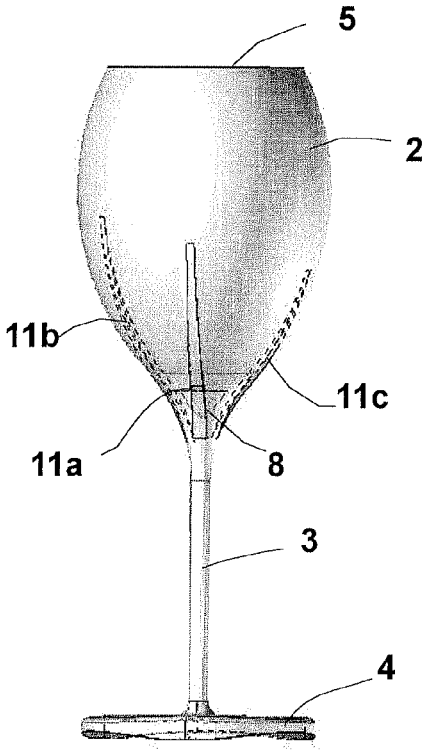
Figure 10:
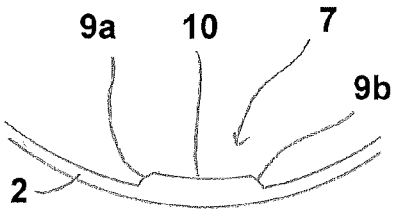
Figure 11:
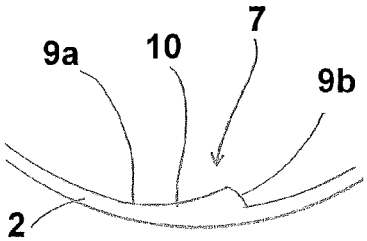
Figure 9A:
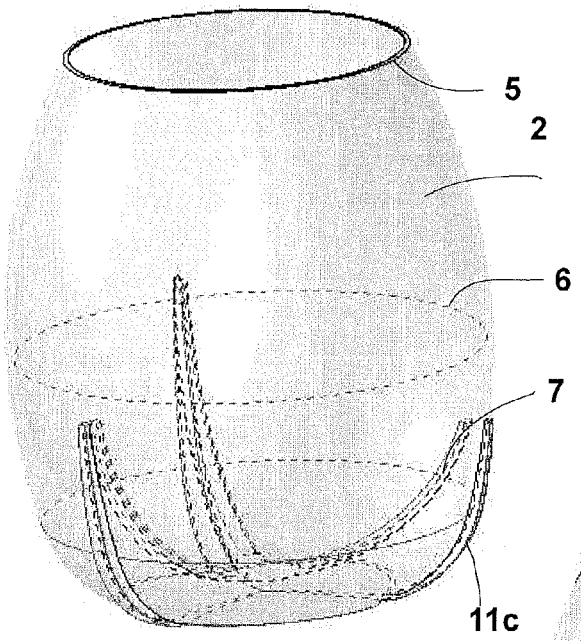
Figure 9B:
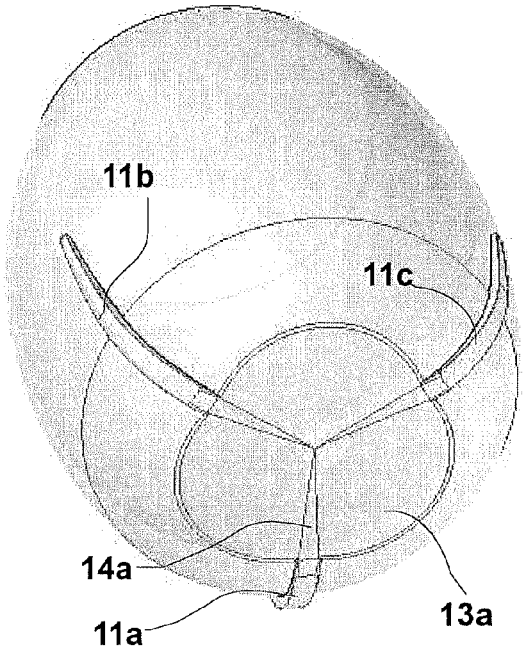
Figure 9C:
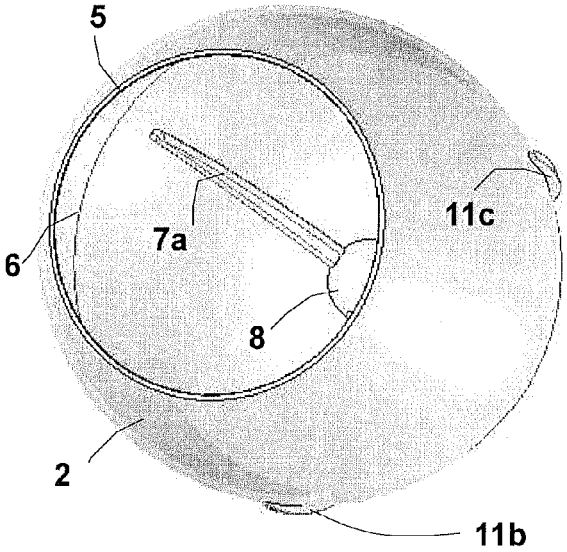

The description that follows, given solely as an example of an embodiment of the invention, is made with reference to the figures included in an appendix, in which:

FIG. 1 is a top view of a tasting glass according to the invention, in the case of a wine glass, FIG. 2 is a side view of such a glass, FIG. 3 is a cross-section perspective view of the glass along a vertical plane parallel to its axis of revolution, highlighting the propeller blade-shaped internal ribs, FIG. 4 is a perspective view from below of the same glass, FIG. 5 is a side view highlighting the section of the foot of the glass, FIG. 6*a* to 6*c* detail the shape of the foot of the glass, FIG. 7 illustrates in the same way a champagne flute according to the invention, highlighting the outer ribs, FIG. 8 is a side view of the same flute, FIGS. 9*a*-9*c* illustrate a goblet also fitted with internal ribs according to the invention, FIG. 10 is a cross-section view of an internal rib, showing the section of said rib, FIG. 11 shows the section of an internal rib in one embodiment.

DETAILED DESCRIPTION OF THE INVENTION

As can be seen in FIGS. 1 to 4, a tasting glass according to the invention comprises a parison 2 designed to receive a fluid, attached to a stem 3, which is itself secured to a foot 4. In this case, the glass in question shows an overall rotational symmetry about a vertical axis Z.

The term "rim" 5 is used in the remainder of the description to designate the upper lip of the parison. The glass 1 is also defined by the line 6 of its largest diameter.

This is a glass with a parison 2 of thirty-five centiliters, rounded and closed at the rim 5 to preserve the wine's flavors. This glass is particularly suited to all types of young still wines, by oxygenating the wine much more.

The dimensions of this glass 1 are as follows: total height of approximately twenty centimeters; parison 2 height of nine centimeters, for a maximum diameter of eight centimeters and a rim diameter of six centimeters. The portion of the parison 2 corresponding to the bottom of the glass has an inner radius of curvature of about four centimeters, while the upper part has a smaller radius of curvature, of the order of eleven centimeters.

The thickness of the parison 2 depends on the method of manufacture of this glass; it is assumed to be known to experts and beyond the scope of the present invention. Nevertheless, it will be thin at the rim and cracked-off.

The invention, however, remains unchanged for a flute- or goblet-type glass 1 or any other type of glass or liquid container with rotational symmetry.

The glass 1 comprises a set of three internal ribs 7*a*, 7*b*, 7*c*, substantially propeller blade-shaped, realized in relief inside the parison 2. These three internal ribs 7 are angularly distributed in an even way in the glass and therefore any two of them are approximately 120° apart.

The lower portion of each of these internal ribs 7 will fuse into a dome 8 protruding at the bottom of the parison 2, substantially along the vertical axis of symmetry Z of the glass 1. In this non-limiting case, the dome 8, shaped substantially as an airplane propeller or turbine "nose-cap", has a height of about 5 mm above the bottom of the glass, and a radius of curvature of ten millimeters.

The internal ribs 7*a*, 7*b*, 7*c* extend substantially along a generatrix of the parison 2 of the glass 1, from the dome 8 at the bottom of the glass to a different height for each of the ribs, and equal in this example to 28, 35 and 42 mm above the bottom of the glass. In addition, these values correspond to seven, eleven and fifteen centiliter fillings of this tasting glass.

The largest internal rib 7*b* thus ends substantially at the largest diameter of the glass 6, which is also the normal filling level of the glass (the largest surface area for maximum oxygenation of the wine), here fifteen centiliters.

The choice of the propeller nose-cap shape of the dome 8 and of the three internal ribs 7 is intended to reproduce, to a certain extent, the shape and function of a propeller within the glass. This propeller is, as can be seen by looking at the figures, pressed against the inner edges of the glass 1.

The section of each inner rib 7 (FIG. 10) is therefore ideally that of a propeller blade surface, e.g. of a wind turbine. In this embodiment, the width of each inner rib 7 decreases from bottom to top, with a width at the bottom of the glass, near the dome 8, of about three to four millimeters and a width in the top part top of about a millimeter and a half to two millimeters. The width of each inner rib 7 at the bottom of the glass is different for each rib (greater for the longest rib, smaller for the shortest rib).

Viewed in cross-section, the width of the inner rib 7 is small in relation to its width, for example about one millimeter, and one to four millimeters when viewed higher up. The sides 9 of the straight section of the inner rib 7 are here shaped into an arc for simplicity of realization. Their sections are symmetrical. The upper part 10 of said inner rib 7 is flat or slightly concave.

In one embodiment, each rib has on its highest or thinnest part, an angle of + or −5 degrees in relation to a vertical plane.

The stem 3 of the glass here is a rod-type, known per se, and about ten centimeters high.

The foot 4 of the glass has the general shape of a thick disk of traditional dimensions in relation to the height and capacity of the glass (e.g. a diameter of seven centimeters for a thickness of seven millimeters), and its axis coincides with the vertical rotational axis Z of the glass.

It comprises, on its lower surface (which is designed to support the glass on its base surface), three substantially flat and coplanar support areas 12*a*, 12*b*, 12*c*, arranged on the periphery of the foot, at an angular separation of 120° to one another. These three support areas 12*a*, 12*b*, 12*c* form an isostatic base for the glass. They are about five millimeters wide and protrude by about two millimeters in relation to the lower surface of the foot 4.

The shape of the lower foot 4 (and that of the support areas 12) is obtained by removing, in a flat disk comprising the three support areas 12*a*, 12*b*, 12*c*, three cylinders sectors 13*a*, 13*b*, 13*c*, having the same radius equal to fifteen centimeters, horizontal axes angularly spaced at 120° from one another, and joining up at a same point of the vertical axis Z of the glass, located 148 mm below the plane formed by the support areas 12. These three cylinders sectors 13*a*, 13*b*, 13*c* are joined by rounded transition zones 14*a*, 14*b*, 14*c*.

This method of design of the lower surface of the foot of the glass explains the shape of the support areas 12, which comprise two ridges 15, 16 oriented at 120°, joined by a rounded portion 17.

This foot shape prevents water drops from stagnating in the lower surface of the foot when the glass is turned upside-down, as is the case for most existing stem glasses.

In this example, the glass according to the invention is realized in crystal. It can also be realized in glass, with or without minerals, crystalline or other material, preferably without lead oxide.

The method of realization of the glass is known per se. It is of machine-mechanical type and comprises, in this example, a step in which the parison 2 is created in a turned and blown mold, a step in which the stem 3 and the foot 4 are created in a fixed press mold, a step in which the stem and foot are assembled onto the parison and a step in which a seam running from the stem 3 to the foot 4 is glazed.

In one variant, the glass can also be realized as mouth-blown.

By giving a rotational movement, known per se, to the glass 1 by hand, traditionally anti-clockwise, the relative displacement produced in the glass is that of a three-bladed propeller stirring the wine.

During the rotation of the wine in the glass, the dome 8 causes a movement of wine towards the wall of the glass, by pressing it onto the inner parison of the glass. The wine will then gradually rise along the wall by being regularly mixed by the internal ribs 7 in the form of propeller-blades, and will release its primary, secondary and tertiary flavors in the free surface of the wine, i.e. between the level of the wine and the rim of the parison of the glass.

The choice of three internal ribs 7 of different heights, the largest of which ends at the normal free level of the wine in the glass, interestingly allows more vigorous stirring of the wine to be achieved at the bottom of the glass, which stirring diminishes with height.

Indeed, above the level of the least tall rib, only two ribs are acting on the stirring of the wine and then just one above the level corresponding to the height of the second rib. Thus the effect obtained is that a vigorous expression of the wine's flavors is maintained, without disrupting the free surface of the wine excessively.

It can be seen that the purpose of the tasting glass according to the invention is certainly not to create a blender by having the edges of internal ribs 7 too sharp, or internal ribs 7 extending too far above the free surface of the wine (this is the case of tasting glasses of the prior state of the art comprising internal ribs), but rather to allow the creation of a series of moderate movements within the wine, and of the wine along the inner wall of the parison 2, which will facilitate the exchange and release of the aromatic molecules of the wine without breaking them, but by shaking them uniformly.

The scope of this invention is not limited to the details of the forms of realization considered above as an example, but on the contrary extends to modifications in the reach of the expert.

The tasting glass as described comprises three internal ribs 7 distributed at 120° from one another. As a variant, it is possible to propose a glass with two internal ribs 7 at 180°, or, conversely, a larger number of internal ribs 7, for example, four internal ribs 7 located at 90°.

In one variant, the internal ribs 7 are hollowed out in the parison 2 of the glass, instead of being realized in relief, while retaining a substantially unchanged shape. In this case, the glass 1 has, of course, a sufficiently thick parison 2 locally, at each internal rib 7, to allow the creation of said internal rib 7.

The use of the glass in this variant remains substantially unchanged.

In another embodiment, providing the same effects of stirring the wine, the ribs 7 in the shape of the propeller blades are not stuck on the parison 2, but are simply substantially parallel to said parison 2, while being a few millimeters distant and just being attached to the glass 1 at the dome 8 at the bottom of the glass, or on a limited portion of their length.

In this case, the internal ribs 7 may advantageously be made of a material resistant to breakage, e.g. as a corrosion-resistant metal alloy.

This arrangement allows the glass 1 to be realized from separate members, including traditional half-parisons whose molds are known, with a final molding of the parison 2 around the dome 8. It also allows a more refined shape of the propeller blades. The stirring of the wine is also improved.

In a variant (FIG. 7), the glass 1 according to the invention comprises a number of external ribs 11 equal to the number of internal ribs 7 on the outer surface of the parison 2; each external rib 11 is, in this non-limiting example, placed opposite an internal rib 7. Each external rib 11 starts at the stem 3 of the glass 1 and extends to a level below the maximum diameter level 6 of the glass.

The purpose of these external ribs 11 is to function as a finger grip when the glass is picked up and thus create a distance between the fingers and the parison 2, so as to prevent the glass 1 being heated locally by the taster. For the three external ribs, one is calibrated and sized at 12.5 cl in order to obtain about six glasses of sparkling wine in a bottle The presence of these external ribs 11 is particularly useful in the case of wines to be served chilled, such as white wines.

For champagne and sparkling wine, the presence of the internal ribs 7 is not desirable, except if it is desired to favor degassing the wine. Only the external ribs 11 are then present.

In a variant specifically dedicated to tasting champagne, illustrated for example in FIGS. 7 and 8, the glass 1 according to the invention, here in the shape of a champagne flute, also comprises a dome 8 at the bottom of the glass, but this time defined as a hollow in the bottom of the glass. Its geometry is broadly unchanged from what has been described above, but hollow. Its embodiment is known per se (molding or other technique).

In this case, the dome 8 is surface treated with a series comprising, typically but not limited to, forty to eighty impacts called "Moussier points", whose function is to help create embryonic bubbles in the shape of a flange, thus contributing to the creation of a genuine crown of foam on the surface of the champagne. The creation of these Moussier points is known to experts and is therefore not detailed further here.

This champagne flute comprises three external ribs 11 as described above, but may possibly not have any internal ribs 7.

In yet another variant (FIGS. 9*a*-9*c*) designed for tasting other beverages such as fruit juice, a glass 1 according to the invention does not comprise a stem 3, but the bottom of the parison 2 also functions as a support area. To achieve this, it has a parison 2 that is considerably thicker in the area of the bottom of the glass, and three external ribs 11 extending initially substantially horizontally, before coming closer to the parison of the glass and to the tangent. It comprises three internal ribs 7, which may not be arranged opposite the external ribs extending from the bottom of the glass up to different heights. They extend almost from the bottom of the glass up to different heights sized and calibrated to 7, 11 and 15 cl. Each inner rib will form, for example, an angle of + or −5 degrees to a vertical plane at its highest or finest part. The large rib extends substantially up to the maximum diameter level 6 of the glass. It is possible that the dome or nose-cap does not exist at the bottom of the inner parison of the glass, in which case, the internal ribs will not extend to the bottom of the glass.

The description was made with internal ribs 7 with a substantially flat, symmetrical surface (their shape following that of the parison), ending in circular arcs (see FIG. 10 for the straight cross-section view of the inner rib).

In one embodiment, illustrated in FIG. 11, the section of each inner rib 7 is asymmetric, with a leading edge 9*a* (in the direction of travel of the wine if the glass is driven in an anticlockwise rotational movement) almost tangential to the parison 2, a trailing edge 9*b* significantly higher (e.g. two millimeters) and a concave central portion 10. Such an internal rib 7 section pushes the wine towards the interior of the glass and increases the movements within it, without creating excessively violent movements in the wine.

The invention claimed is:

1. Drinking glass (1), comprising;

a parison (2) generally being rotationally symmetrical around a vertical axis Z, within said parison (2), a set of at least two internal ribs (7) evenly distributed on a periphery of the parison (2), each of the internal ribs (7) extending substantially along a generatrix of the parison (2), almost from the bottom of the parison (2), up to a height of the parison, toward a rim of the parison, the height of the ribs lower than or equal to a normal filling level of the glass, different for each of the internal ribs, and at the bottom of the parison (2), along the axis of symmetry of the glass, a hollow dome (8) on which the internal ribs (7) fuse, wherein the hollow dome (8) comprises between forty and eighty Moussier point impacts.

2. Glass according to claim 1, wherein, the glass has plural normal fill levels, and the height of each internal rib (7) corresponds to a different normal fill level of the glass.

3. Glass according to claim 1, comprising three of said internal ribs (7*a*, 7*b*, 7*c*).

4. Glass according to claim 3, wherein the heights of the three internal ribs (7*a*, 7*b*, 7*c*) are 28, 35 and 42 mm above the bottom of the parison and correspond respectively to seven, eleven and fifteen centiliter fillings of the glass.

5. Glass according to claim 1, wherein the internal ribs (7) protrude from the inner surface of the parison (2).

6. Glass according to claim 1, further comprising, at the bottom of the parison (2), along the axis of symmetry of the glass Z, a protruding dome (8) on which the internal ribs (7) fuse.

7. Glass according to claim 1, wherein the internal ribs (7) are of a propeller blade surface shape.

8. Method of realizing a tasting glass according to claim 1, wherein the method comprises steps in which:

the parison (2) is created in a turned and blown mold and a dome (8) is realized by deformation of the bottom of the parison by the upper extremity of a stem (3), the stem (3) is created in a fixed press mold or as a stretched stem, and a foot (4) is created in a fixed press mold, the stem and foot are assembled onto the parison, and a seam going from the stem (3) to the foot (4) is glazed when a leg is realized in a fixed press mold.

9. Glass according to claim 1, wherein, the drinking glass is a wine tasting glass, the parison is configured as a wine tasting parison for a wine tasting glass with a smooth arcuate inner surface running from almost the bottom of the parison toward a rim of the parison, the smooth arcuate inner surface the parison comprising a first portion corresponding to the bottom of the parison, and an adjoining second portion corresponding to an upper part of the parison extending toward the rim of the parison, the first portion of the smooth arcuate inner surface the parison corresponding to the bottom of the parison has a first inner radius of curvature, and a second portion of the smooth arcuate inner surface the parison corresponding to the upper part of the parison has a second radius of curvature smaller than the first radius of curvature.

10. Drinking glass (1), comprising;

a parison (2) generally being rotationally symmetrical around a vertical axis Z, within said parison (2), a set of at least two internal ribs (7) evenly distributed on a periphery of the parison (2), each of the internal ribs (7) extending substantially along a generatrix of the parison (2), almost from the bottom of the glass, up to a height of the parison lower than or equal to a normal filling level of the glass, different for each of the internal ribs, and at the bottom of the parison (2), along the axis of symmetry of the glass, a hollow dome (8) on which the internal ribs (7) fuse, wherein the hollow dome (8) comprises between forty and eighty Moussier point impacts.

11. A wine tasting glass (1) having plural normal filling levels, comprising;

a parison (2), the parison (2) being generally being rotationally symmetrical around a vertical axis (Z);

a stem (3) attached to the parison (2);

a foot (4) attached to the stem (3);

internal ribs (7) evenly distributed on a periphery of the parison (2) within said parison (2), each of the internal ribs (7) having a different length extending substantially along a generatrix of the parison (2), from a bottom area of the parison (2) up to a height of the parison lower than or equal to a respective one of the normal filling levels such that each of the internal ribs (7) corresponds to one of the normal filling levels; and at the bottom of the parison (2), along the axis of symmetry of the glass, a dome (8) on which the internal ribs (7) fuse, wherein the dome (8) comprises Moussier point impacts.

12. The wine tasting glass of claim 11, wherein, a total height of the parison is nine centimeters, a maximum diameter of the parison is eight centimeters, a rim diameter of the parison is six centimeters, a portion of the parison corresponding to the bottom has an inner radius of curvature of about four centimeters, and an upper part of the parison is has a smaller radius of curvature of an order of eleven centimeters.

13. The wine tasting glass of claim 11, wherein, the parison comprises a smooth arcuate inner surface running from the bottom area of the parison upward toward a rim of the parison, the smooth arcuate inner surface of the parison comprising a first portion corresponding to the bottom area of the parison, and an adjoining second portion corresponding to an upper part of the parison extending toward the rim of the parison, the first portion of the smooth arcuate inner surface the parison corresponding to the bottom of the parison has a first inner radius of curvature, and a second portion of the smooth arcuate inner surface the parison corresponding to the upper part of the parison has a second radius of curvature small than the first radius of curvature.

14. The wine tasting glass of claim 12, comprising three of said internal ribs (7*a*, 7*b*, 7*c*) with respectively having heights 28, 35 and 42 mm above the bottom area of the parison and corresponding respectively to seven, eleven and fifteen centiliter fillings of the glass.

15. The wine tasting glass of claim 13, comprising three of said internal ribs (7*a*, 7*b*, 7*c*) with respectively having heights 28, 35 and 42 mm above the bottom area of the parison and corresponding respectively to seven, eleven and fifteen centiliter fillings of the glass.

* * * * *